US007245267B2

(12) United States Patent
Gottl et al.

(10) Patent No.: US 7,245,267 B2
(45) Date of Patent: Jul. 17, 2007

(54) MOBILE RADIO ANTENNA RADOME WITH INTEGRAL REFLECTOR

(75) Inventors: Maximilian Gottl, Frasdorf (DE); Johann Obermaier, Weiching (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 11/106,675

(22) Filed: Apr. 15, 2005

(65) Prior Publication Data

US 2006/0176235 A1 Aug. 10, 2006

(30) Foreign Application Priority Data

Feb. 8, 2005 (DE) ..... 10 2005 005 781

(51) Int. Cl.
*H01Q 1/42* (2006.01)

(52) U.S. Cl. ..... 343/872; 343/702; 343/912

(58) Field of Classification Search ..... 343/702, 343/872, 912, 781 P, 781 CA
See application file for complete search history.

(56) References Cited

U.S. PATENT DOCUMENTS

| | | | | |
|---|---|---|---|---|
| 4,287,520 | A | 9/1981 | Van Vliet et al. | |
| 4,467,330 | A | 8/1984 | Vidal et al. | |
| 4,581,615 | A * | 4/1986 | Levy | 343/755 |
| 5,103,241 | A | 4/1992 | Wu | |
| 5,423,072 | A * | 6/1995 | Iwashita et al. | 455/67.14 |
| 5,652,631 | A * | 7/1997 | Bullen et al. | 343/872 |
| 5,710,569 | A | 1/1998 | Oh et al. | |
| 5,977,710 | A * | 11/1999 | Kuramoto et al. | 343/700 MS |
| 6,020,859 | A * | 2/2000 | Kildal | 343/781 CA |
| 6,184,840 | B1 * | 2/2001 | Hsin-Loug et al. | 343/781 P |
| 6,774,854 | B2 * | 8/2004 | Wannagot et al. | 343/700 MS |
| 6,885,352 | B2 | 4/2005 | Lee et al. | |
| 6,903,689 | B2 * | 6/2005 | Apostolos et al. | 343/700 MS |
| 7,042,407 | B2 * | 5/2006 | Syed et al. | 343/705 |
| 2001/0005180 | A1 * | 6/2001 | Karlsson et al. | 343/775 |

FOREIGN PATENT DOCUMENTS

| | | |
|---|---|---|
| CA | 2199581 | 2/2000 |
| DE | 196 27 015 A1 | 1/1998 |
| DE | 197 22 742 A1 | 12/1998 |
| DE | 198 30 791 A1 | 9/1999 |
| DE | 697 08 358 T2 | 7/2002 |
| DE | 101 50 150 A1 | 5/2003 |
| DE | 10217330 A1 | 5/2003 |
| EP | 0 916 169 B1 | 5/1998 |
| EP | 0930668 A1 | 7/1999 |
| EP | 1 194 982 B1 | 7/2000 |
| FR | 1004622 | 4/1952 |
| JP | 2000-307337 | 11/2000 |
| JP | 2005-33404 | 2/2005 |
| JP | 2005-033404 | 2/2005 |
| WO | WO 99/43044 | 8/1999 |
| WO | 00/39894 | 7/2000 |
| WO | WO 03/043128 A1 | 5/2003 |
| WO | WO 03/090384 A1 | 10/2003 |

OTHER PUBLICATIONS

Search report issued in corresponding German application, 3 pages (Jun. 27, 2006).

* cited by examiner

*Primary Examiner*—Tan Ho
(74) *Attorney, Agent, or Firm*—Nixon & Vanderhye P.C.

(57) ABSTRACT

An improved radome comprises at least one conductive flat structure integrally incorporated in the material of the radome, which acts as a reflector for a mobile radio antenna at least partially enclosed within the radome.

25 Claims, 12 Drawing Sheets

MOBILE RADIO ANTENNA RADOME WITH INTEGRAL REFLECTOR

FIELD

The technology herein relates to a radome for mobile radio antennas, and to an associated mobile radio antenna.

BACKGROUND AND SUMMARY

Mobile radio antennas for base stations normally have a vertically running conductive reflector which may possibly also be provided with webs, edge boundaries etc. which run in the longitudinal or vertical direction and are offset outwards from the center, and which extend such that they run at right angles to the reflector plane or at an angle to it. Two or more antenna elements or antenna element groups which are offset in the vertical direction are generally arranged in front of the reflector and, for example, can transmit and/or receive in one polarization or else in two mutually perpendicular polarizations.

The dual-polarized antenna elements are frequently aligned at angles of +45° and −45° to the vertical (and to the horizontal), so that they are also referred to as X-polarization antenna elements.

The antenna elements and antenna element groups may be arranged alongside one another in one or more columns. Antenna arrays such as these which comprise two or more columns alongside one another generally, however, likewise have a common reflector or a common reflector plate.

All feasible antenna elements may be used as the antenna elements, for example single-polarized or dual-polarized antenna elements, dipole antenna elements or dipole-like antenna elements, patch antenna elements etc. With regard to the various antenna element types that are used, reference is made merely by way of example to the following prior publications, specifically DE 197 22 742 A1, DE 196 27 015 A1, U.S. Pat. No. 5,710,569, WO 00/39894 or DE 101 50 150 A1.

Antenna arrangements such as these are normally accommodated in a radome which is used to protect the antenna elements against weather influences. The radome itself allows electromagnetic waves to pass through it and is generally composed of a glass-fiber-reinforced plastic.

Although mobile radio antennas can be designed such that the radome, which is similar to a housing, has a front face which is in the form of a shell and which can be fitted to the antennas and to the baseplate which covers the reflector, a radome is also frequently used which is closed in the circumferential direction and is open on its opposite end faces, where it can be closed by fitting terminating caps which are composed of glass-fiber-reinforced plastic or else, for example, of metal. The appropriate electrical connections for the feed lines as well as further measures, for example for adjusting the downtilt angle, etc., are also provided on the connecting cap located at the bottom. These electrical connections may, however, also be provided on the rear face of the radome, that is to say at the rear on the radome. Finally, appropriate holding and fixing devices are also provided, via which the entire antenna is, for example, held and fixed on a mast. These holding and fixing devices are generally provided on the respective load-bearing parts of the structure, for example on the reflector, on the radome itself, etc.

It is known for mobile radio antennas to generally be designed to transmit only in one specific sector, for example for a sector of 120°, ±30° or 180°±30°, etc. A high back-to-front ratio is thus frequently desirable, which should be greater than 20 dB, and frequently even greater than 25 dB, or even greater than 30 dB.

In order to achieve a better back-to-front ratio, an additional metal sheet can already be fitted at a distance behind the rear face of the radome in the case of a mobile radio antenna which is accommodated in a radome (in which case the entire antenna device including the reflector as well as the antenna elements or antenna element groups which are formed on it is accommodated in the radome, which is closed in the circumferential direction). This effectively results in a "double reflector", thus improving the back-to-front ratio.

Attempts have already been made not to install this second reflector separately at a distance behind the radome but to apply to the rearward face of the radome itself, or the inner face of the radome.

The technology herein provides an improved exemplary illustrative non-limiting radome in particular for a mobile radio antenna, as well as an associated mobile radio antenna, whose design is simple and efficient and which has optimum electrical characteristics.

The exemplary illustrative radome is distinguished by flat line structures being incorporated in the material of the radome itself. Thus, in other words, flat line structures are incorporated in the material of the radome itself during the radome production process, and generally cannot be seen at all from the outside. If, by way of example, a large-area line structure is incorporated in the rearward wall of a radome such as this which, for example, is composed of glass-fiber-reinforced plastic, then a reflector can be formed in this way. The reflector itself cannot be seen from the outside unless the rearward wall of the radome is drilled open or external material layers of the radome were to be removed.

A reflector such as this need neither be produced separately nor be fitted and installed separately. It is integrated in the radome itself.

These large-area conductive structures may, however, be incorporated not only on the rearward wall but, in some cases, also in the side wall areas (which in general also run vertically when the antenna is installed with the radome aligned vertically), so that, by way of example, side outer webs or edge boundaries are formed, such as those which are also known per se for reflectors which are manufactured separately from metal sheets.

Finally, flat line structures such as these could, however, even be accommodated on a different face in the radome, for example even in the front face. This would make it possible, for example, to form passive or else active line patches which are located, in particular, above antenna elements formed from patch antennas. In the case of an active patch, the patch may be stimulated as an antenna element, for example by means of an aperture coupling. This is normally done using a printed circuit which contains a feed network above a ground plane. The ground plane has a slot (aperture) which is stimulated by the feed network. This slot is then coupled to the patch. No conductive connection to the patch is required with this type of patch feed.

The flat line structures may be produced in widely differing ways. These flat line structures may, for example, have a hole structure or a grating structure. They may be composed of conductor tracks running in the longitudinal direction, or else conductor tracks running transversely, particularly when these conductor tracks are connected via non-conductive cable structures running in the longitudinal direction. In an exemplary illustrative non-limiting implementation there are no restrictions to a specific structure or to a specific material. When grating or hole structures are used, only the mesh, grating or hole size should be designed appropriately such that it is suitable for the corresponding waveband of the mobile radio antenna. In other words, the hole size of such a hole or grating structure should therefore be smaller than $\lambda/10$, when $\lambda$ represents the wavelength of the highest transmitted frequency.

In one exemplary illustrative non-limiting implementation, the flat line structure to be incorporated may be composed of metal, for example aluminum or an aluminum foil, which is coated in the factory itself on both sides with paper or a material which includes paper. Such coated metal foils or, in particular, aluminum foils are commercially available and can be incorporated particularly well in a radome during production, since the outer layers of the metal foil, which are composed of paper or include paper, can be impregnated with resin particularly well so that a particularly good connection of a flat line structure such as this can be incorporated in a radome which is composed of plastic, in particular glass-fiber-reinforced plastic.

A radome such as this is preferably also used for omnidirectional antenna elements which, for example, can be held via the end caps which are placed on the radome. This allows an omnidirectional antenna element to be used to produce a corresponding directional antenna element, in which case the 3 dB beamwidth of the antenna is defined by the size of the flat line structure incorporated in the radome and by the reflector formed in this way.

A radome such as this forming an incorporated reflector can be used to improve the back-to-front ratio.

This is because the use of a radome such as this for a mobile radio antenna with a separate reflector on which the antenna elements and antenna element structures are formed effectively results in a double reflector.

The exemplary illustrative radome thus has a large number of advantages. In comparison to conventional solutions, the exemplary illustrative solution with a reflector incorporated in the radome material leads to the radome being lighter overall, to the incorporated reflector being better protected, and the entire radome arrangement thus also becoming denser (because, for example, there is no need to fit an additional reflector and install an additional reflector on the inside or outside of the radome). In particular, when additional reflector devices such as these were adhesively bonded to the radome material in the prior art, there was also a risk of them becoming detached from the radome material again when these reflectors were subjected to a large amount of heat. Finally, this also avoids the creation of intermodulation products. Furthermore, the total number of components required is also reduced, and the overall assembly complexity is simplified and reduced.

BRIEF DESCRIPTION OF THE DRAWINGS

Further details, features and advantages will become evident from the exemplary embodiments which are explained in the following text with reference to the drawings in which, in detail.

DETAILED DESCRIPTION

Figure 1:
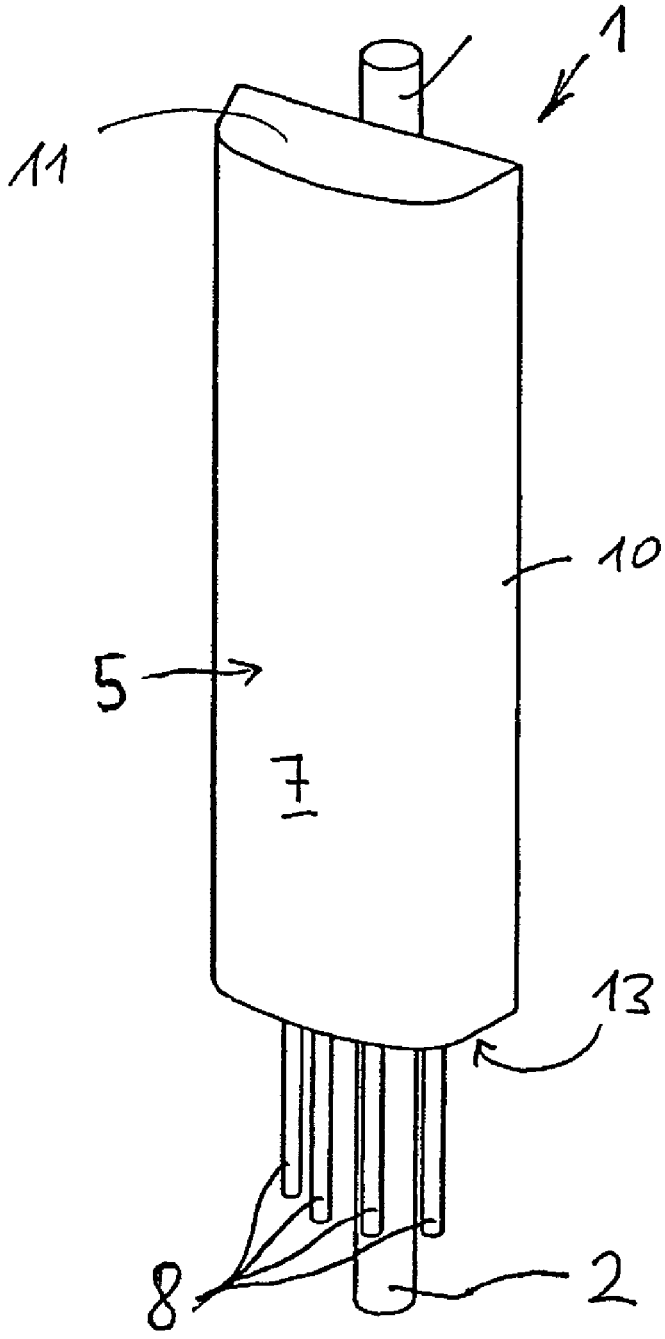
FIG. 1 shows a schematic perspective illustration of a mobile radio antenna with a radome which is attached to a mast.

FIG. 1 shows a schematic illustration of a mobile radio antenna 1 which, for example, is part of a base station. The mobile radio antenna 1 is held and adjusted via a mast 2. In the interior, the mobile radio antenna 1 has a reflector 3, which cannot be seen in FIG. 1 but in front of which a large number of antenna elements, for example dipole antenna elements, patch antenna elements etc. are generally arranged, offset with respect to one another in the vertical direction.

The antenna elements may be any desired suitable antenna elements or antenna element groups as are known in principle, for example, from the prior publications DE 197 22 742 A1, DE 196 27 015 A1, U.S. Pat. No. 5,710,569, WO 00/39894 or DE 101 50 150 A1.

The antenna elements or antenna element groups are accommodated in a protected manner underneath a radome 5, with the radome 5 generally being produced as an integral body which is closed in the circumferential direction and has a front face 7 which has a rather domed shape, side wall sections 10 and a rear face 9, which is generally fairly flat. An upper covering cap 11 can be fitted and attached to the upper face, and a corresponding lower terminating cap 13 (FIG. 1) can be fitted and attached to the lower face. The lower terminating cap 13 is frequently, however, also in the form of a metal flange on which the electrical connections for the antenna elements located in the antenna or for other control devices are then provided in order, for example, to set a different downtilt angle. FIG. 1 shows cables 8 which lead to the connections on the lower face of the antenna cover. In this context, reference should be made to known solutions.

Figure 2:
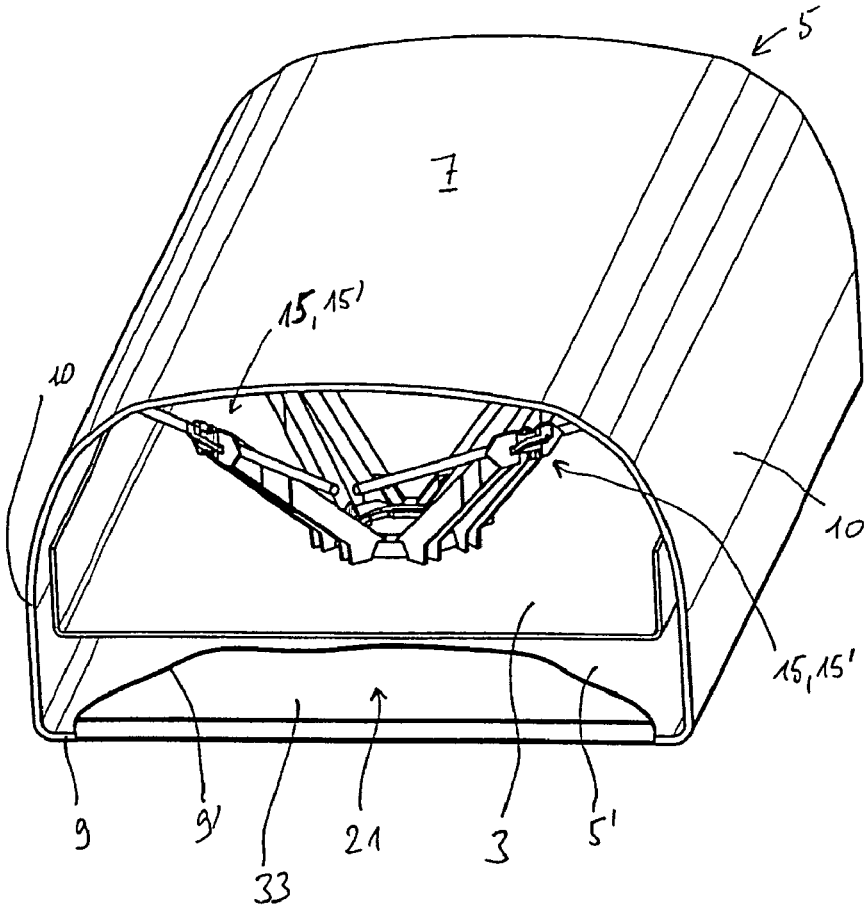
FIG. 2 shows a schematic perspective section illustration through an antenna with an exemplary illustrative radome having a flat line structure incorporated in the rearward face.

FIG. 2 now shows a perspective detail from a section illustration in which the mobile radio antenna has a radome 5 which is closed in the circumferential direction and within which a conductive reflector 3 is accommodated, which is generally composed of metal. The reflector 3 in this case also has two side wall sections or webs 3*a*, which likewise run in the vertical direction and at the same time can be positioned at right angles, or at an angle other than this, to the reflector plane.

Suitable antenna elements for the mobile radio band are then arranged separated from one another in the vertical direction. FIG. 2 shows a partially perspective illustration of a dual-polarized antenna element 15 which comprises a dipole square 15' and is mounted on the reflector 3 above the associated balancing device 17. The connecting lines are located on the rear face of the reflector, but are not illustrated overall.

In the illustration shown in FIG. 2, the upper layer 9' on the inside of the rearward wall 9 of the radome has been partially omitted so that it is possible to see the conductive structure 21 which is incorporated in the rearward wall or rear face 9 and which is in some cases also referred to as a flat line structure in the following text.

This flat line structure 21 may extend over the entire length or height of the radome in the rear face 9, or only over a part of the entire length or height of the radome in the rear face 9, and may be composed, for example, of a continuously closed metal layer, a metal foil or a metal sheet, which is incorporated in the wall of the radome during the radome production process, that is to say a material layer 5' generally covers the radome on the radome generally covers both the inside of the radome and the outside of the radome, and cannot be seen from the outside. This results in a second reflector 33, which is incorporated in the rearward radome wall and is located at a distance from the reflector 3 (which is located within the radome) and parallel to it, that is to say behind it.

Figure 3:
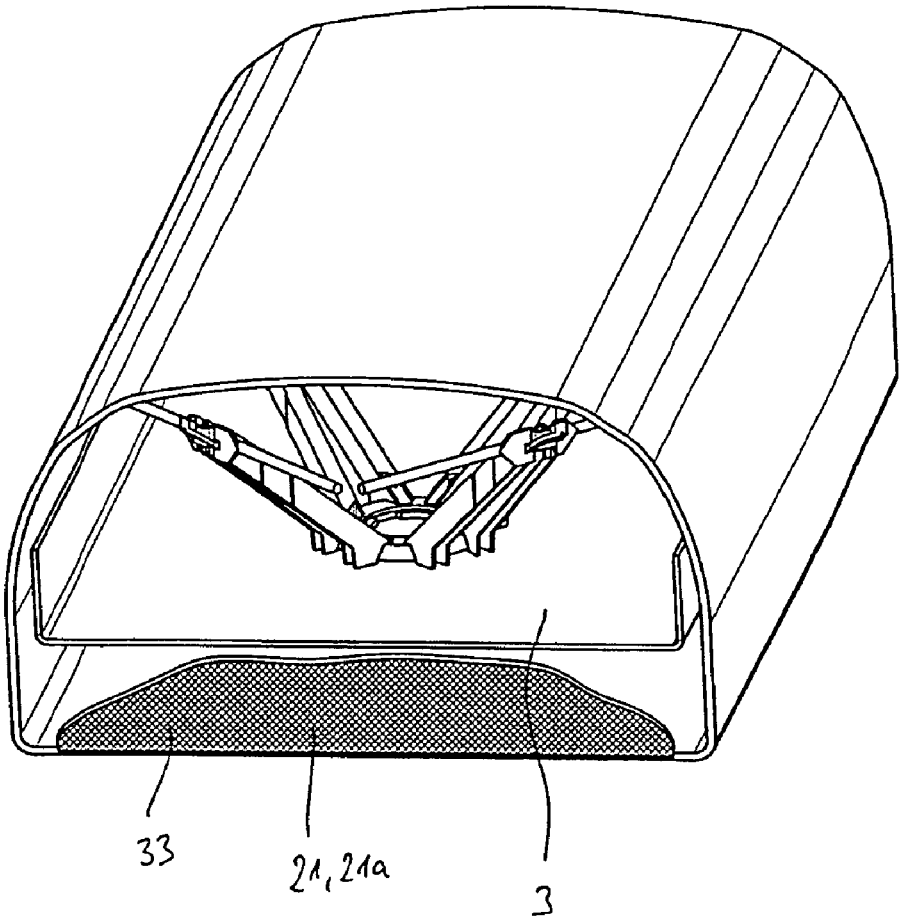
FIG. 3 shows an illustration corresponding to that in FIG. 2, with a mesh-like metal foil incorporated in it.

In the exemplary embodiment shown in FIG. 3, the line structure is in the form of a narrow-mesh structure 21*a*, whose grating or mesh lines are aligned, for example, such that they run at angles of +45° and −45° to the vertical and the horizontal. This mesh-like structure is conductive.

Figure 4:
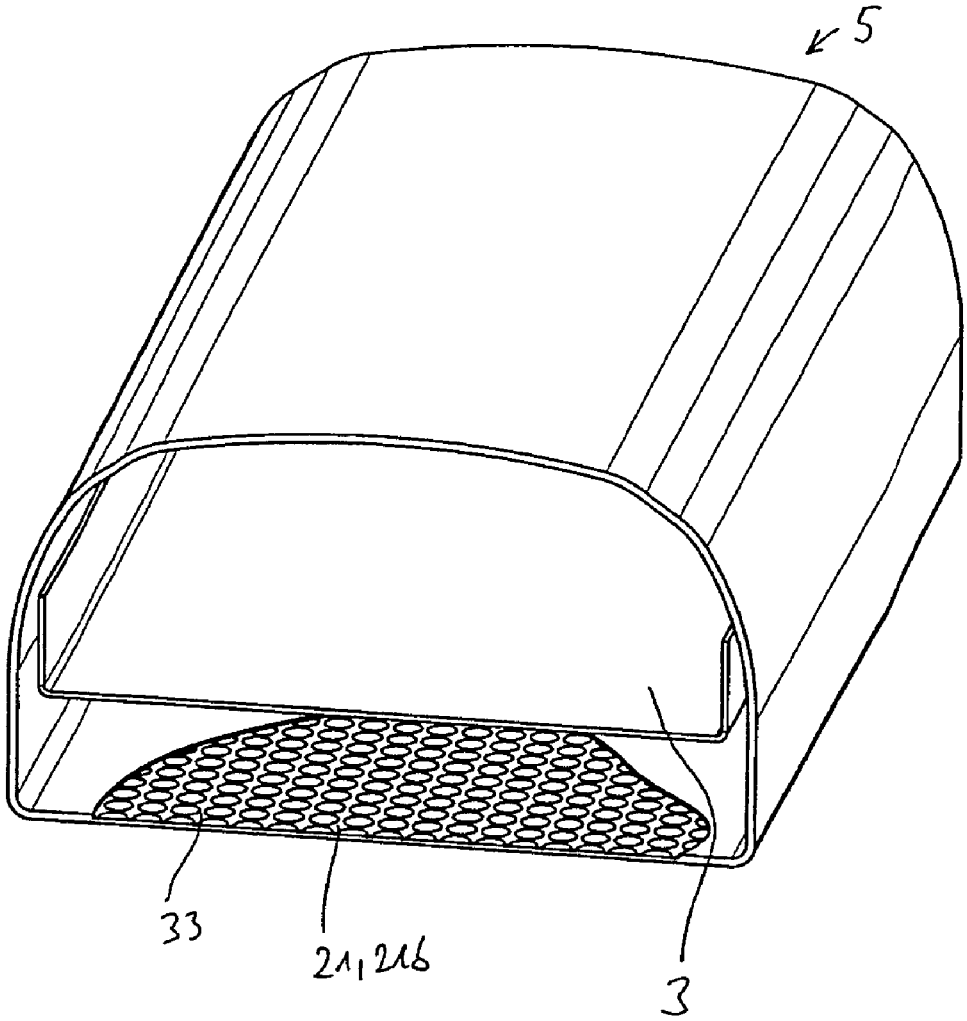
FIG. 4 shows an illustration corresponding to that in FIG. 2 or 3 with a flat line structure with a hole pattern incorporated in it.

In the exemplary embodiment shown in FIG. 4, a hole structure 21*b* is used as the line structure. This may be a metal foil or a metal sheet (as thin as possible), which is provided with an appropriate hole structure. The hole rows need not run exactly in the vertical or longitudinal direction but can also be provided by holes which are located with a lateral offset with respect to the holes in the adjacent row, from one row to the next, so that, in fact, the hole rows are aligned, for example, such that they run at an angle to the vertical or longitudinal direction of the radome, for example at angles of +45° and −45° to the horizontal or vertical.

Figure 5:
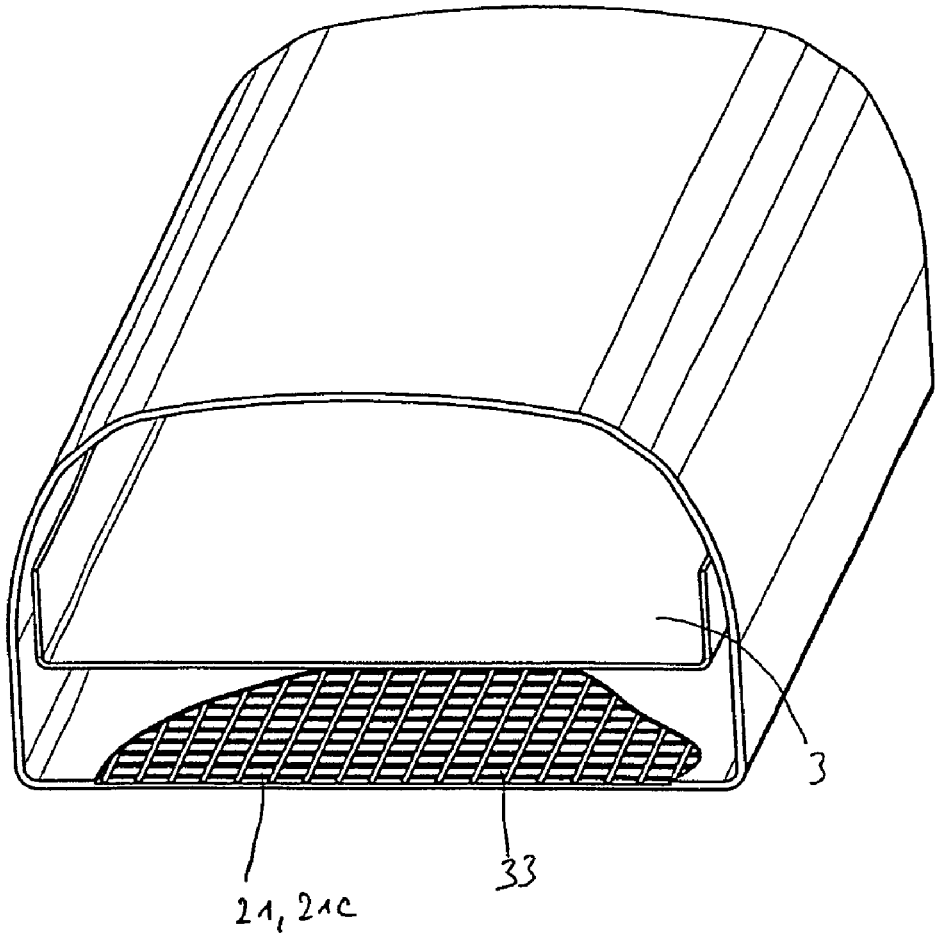
FIG. 5 shows a corresponding illustration with a flat line structure incorporated in it, with a grid in the form of a grating with grating rods running in the longitudinal and lateral directions.

The exemplary embodiment shown in FIG. 5 now uses a grating structure 21*c* in which the grating webs run in the horizontal or vertical direction, that is to say in the longitudinal or lateral direction of the radome. However, in this case as well, the grating structure may be provided such that it runs with a different angular alignment.

Figure 6:
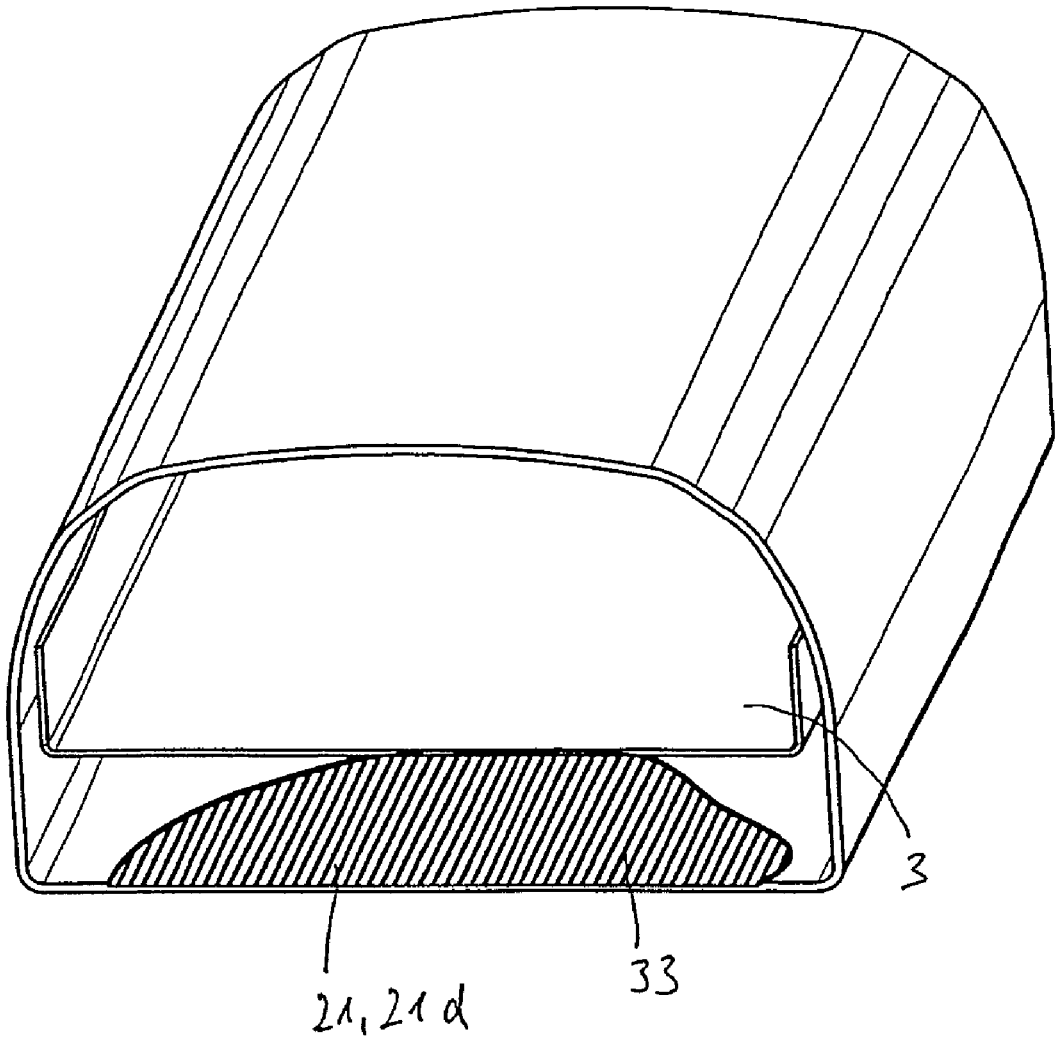
FIG. 6 shows a corresponding illustration with a strip grating, which runs in the longitudinal direction, as the flat line structure.

The exemplary embodiment shown in FIG. 6 uses a line grating structure 21*d* which, for example, may be composed of a large number of longitudinal wires running parallel to one another. Furthermore, cross-connections can also be provided, which run beyond the longitudinal wires in the lateral direction and hold and stabilize their alignment during the production process. These cross-connections would then, by way of example, be non-conductive.

Figure 7:
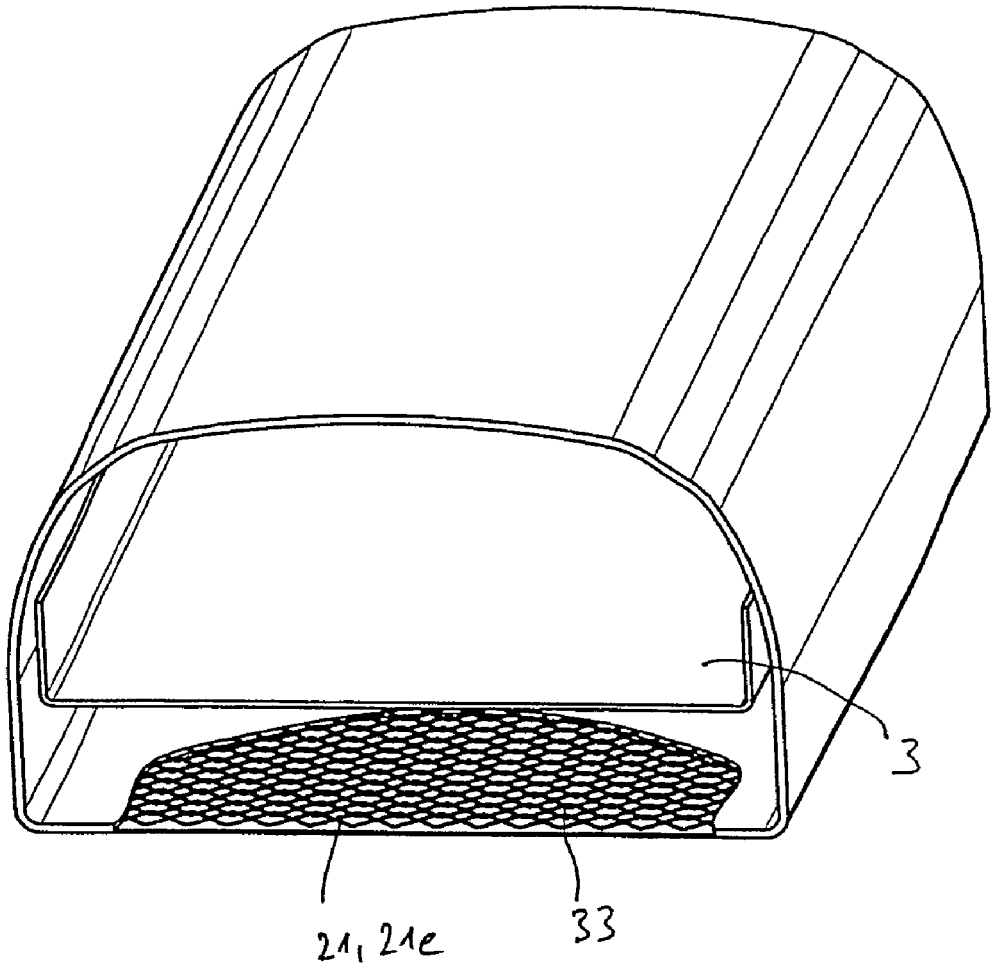
FIG. 7 shows a further modified exemplary embodiment with a structure which is more in the form of a wire mesh, and with the grating or hole openings having different sizes.

The exemplary embodiment shown in FIG. 7 uses a flat line structure 21*e* which is in the form of a wire mesh, thus resulting in hole rows which have hole diameters of at least two different sizes.

Figure 8:
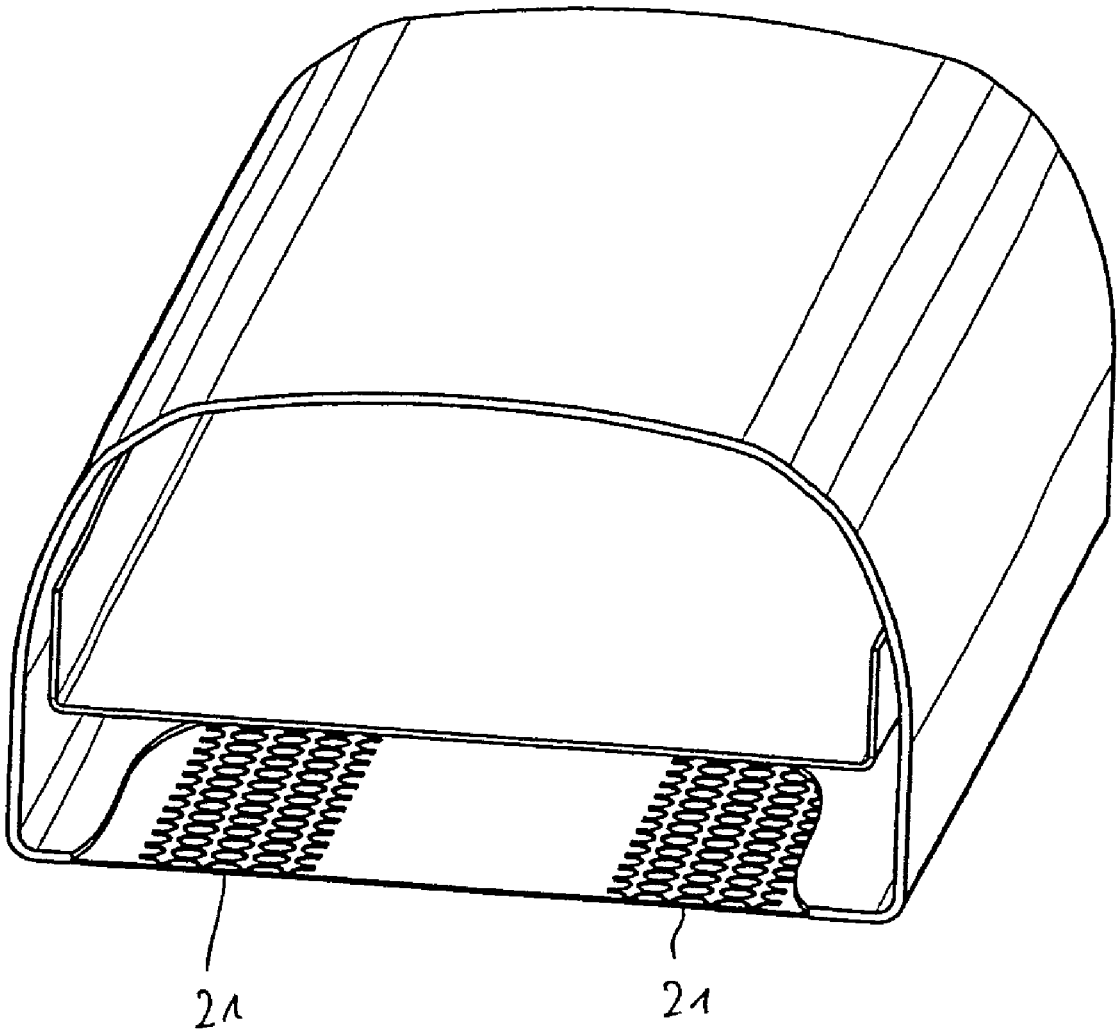
FIG. 8 shows a modified exemplary embodiment with two separate flat line structures which run in the longitudinal direction and are separated in the lateral direction, and the rearward edge of the radome.

Finally, as can be seen from FIG. 8, the flat line structures need not pass through the entire width of the rear wall 9 of the radome 5, but two or more flat structures 21 may also be provided which, for example, run in the longitudinal direction and are arranged with a lateral offset with respect to one another.

Figure 9:
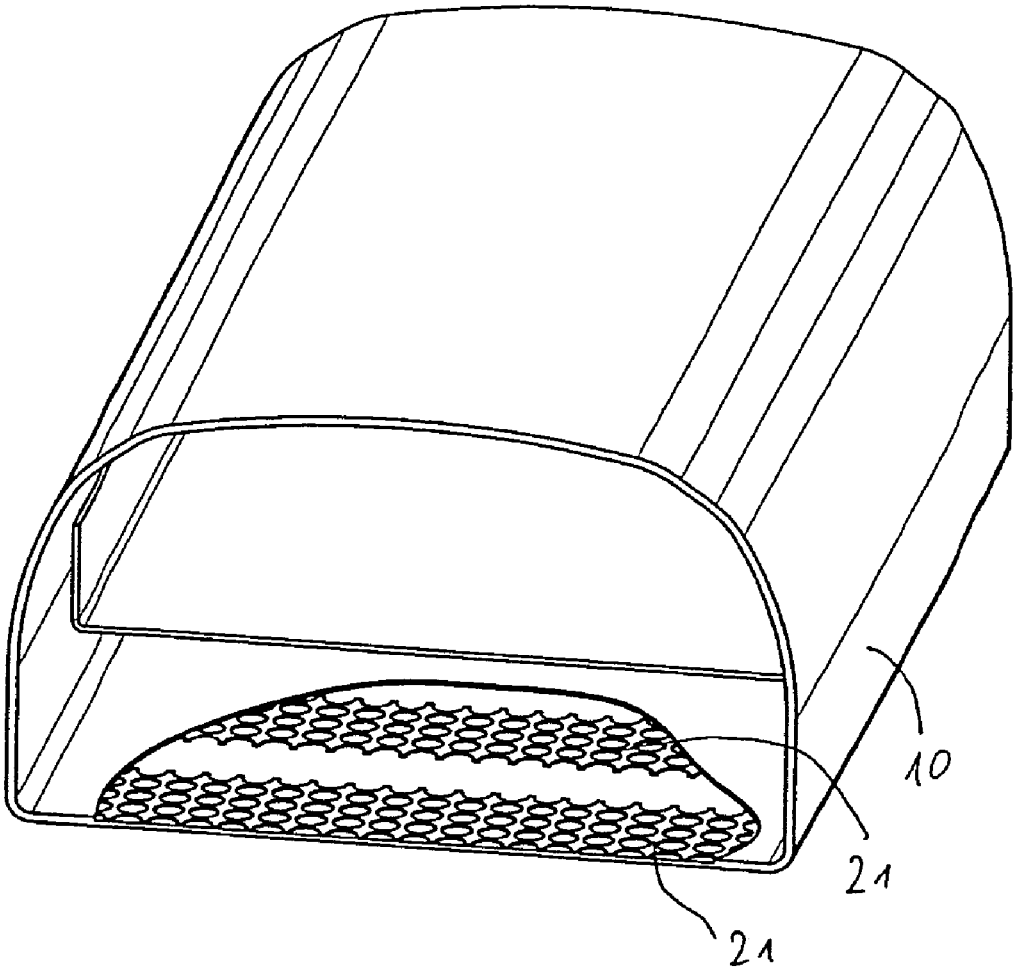
FIG. 9 shows a further exemplary embodiment with flat line structure sections which run in the lateral direction and are separated from one another in the longitudinal direction.

FIG. 9 in this case shows that the corresponding two or more line structures can run not only in the longitudinal direction but, for example, also in the lateral direction and can in each case be arranged with a lateral offset with respect to one another in the longitudinal direction of the radome, forming separations 23. These structures thus also result in the formation of a second rearward reflector 33, in front of which the actual reflector 3 that is located in the radome is arranged.

Figure 10:
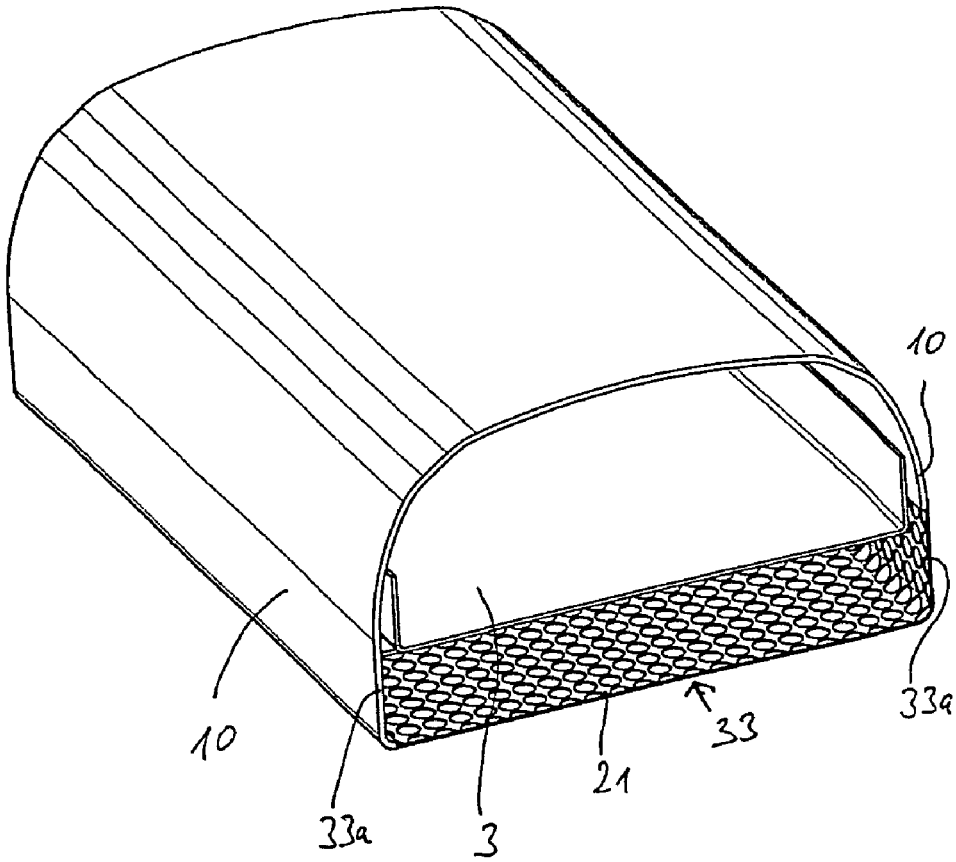
FIG. 10 shows a further exemplary embodiment, in which the flat line structure is formed into the side wall area, forming side boundaries or side webs.

The exemplary embodiment shown in FIG. 10, finally, illustrates that the conductive structures need not be incorporated just in the rear wall 9 of the radome 5. In the exemplary embodiment shown in FIG. 10, the conductive structure 21 is incorporated such that it extends into the side wall area 10 of the radome 5, where it extends over part of the height of the entire radome. This results in an integrated reflector 33, which is effectively likewise once again formed with side wall boundaries or side wall webs 33*a*.

Although this is not illustrated in any more detail in the drawings, it is, however, also possible by way of example to provide rectangular recesses in the conductive side wall structure in the side wall webs 33*a*, which form the side wall webs 33*a*. This would effectively result in the formation of "slots" or "windows" in the conductive side wall webs 33*a*, which are used as passive beamforming elements (as is described, for example, in principle in the prior-published EP 0 916 169 B1 as well, whose entire disclosure content is included here by reference). However, decoupling structures or decoupling elements, which are conductive, can also be provided in the side wall webs 33*a*. These may comprise, for example, raised areas in the form of pins which extend at right angles to the reflector plane, running in the side wall sections 33*a*, and at the same time project to a certain extent beyond the upper edge of the side wall webs. These decoupling elements or structures are thus also part of the conductive structure 21. With regard to the design of such decoupling elements, reference should be made in principle to EP 1 194 982 B1, whose entire disclosure content is included here by reference.

In all of the exemplary embodiments explained above, the incorporation of an integrated reflector 33 in particular in the rear wall 9, and possibly also extending into the side wall areas 10 of the radome 5, has resulted in a second reflector which is provided in addition to and at a distance from the fairly conventional reflector 3 which is arranged within the reflector. This results in a double-reflector structure, thus making it possible to considerably improve the back-to-front ratio in comparison to conventional solutions. Since the integrated reflector is incorporated in the rear wall of the radome, this results in the advantage that this integrated reflector 33 is protected against environmental influences, is not visible, and the entire arrangement is in consequence denser (because there is no need to attach a separate reflector to the rear wall, that is to say no further holes, rivets, etc. are required). This also avoids disadvantageous influences on the isolation and protective effect of the radome. Finally, despite the integrated reflector, only one component, which can be handled in a uniform manner, is provided in the form of the radome.

Figure 11:
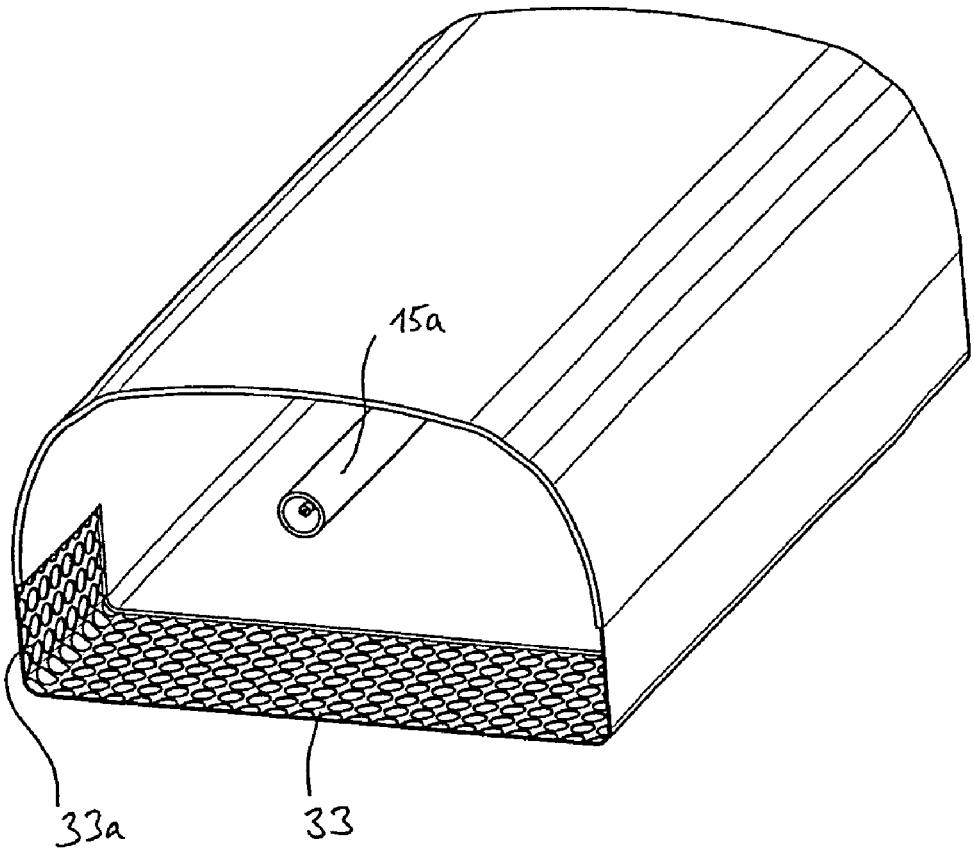
FIG. 11 shows an illustration of a directional antenna which is formed from an omnidirectional antenna.
Figure 12:
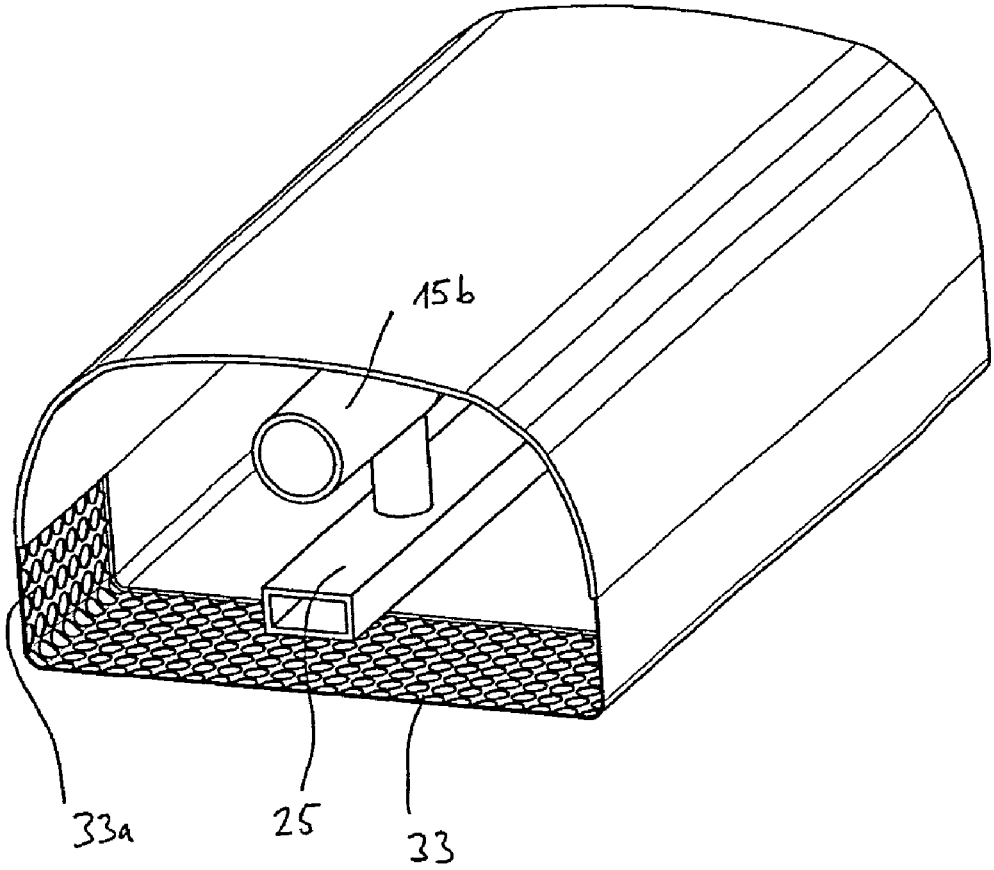
FIG. 12 shows a corresponding illustration of an antenna which is polarized in the vertical direction.

However, the exemplary embodiments shown in FIGS. 11 and 12 will now be used to illustrate that, by way of example, it is possible to use an antenna arrangement in the form of an omnidirectional antenna element (FIG. 11) or in the form of, for example, linear-polarized antenna elements (vertically polarized dipole antenna elements) as shown in FIG. 12 which interact with only a single reflector, with only the integrated reflector 33 being used for this purpose, without any additional separately installed reflector 3.

By way of example, an omnidirectional antenna element 15*a* has been used in the exemplary embodiment shown in FIG. 11, which passes through the space within the radome at a distance in front of the rear wall in the longitudinal direction and which, for example, is mechanically held by the upper covering cap 11 and the lower terminating cap 13 (see FIG. 1).

In the exemplary embodiment shown in FIG. 12, the single-polarized dipole antenna elements 15*b*, which are used in the longitudinal or vertical direction, are mounted on a hollow supporting and connecting strip 25 within which the antenna cable to the antenna elements 15*b* can also be laid. This supporting strip 25 can be fitted or attached to the inner face of the rear wall 9 of the radome 5 or can be held at a distance from it, for example likewise once again via the upper covering cap 11 and the lower terminating cap 13 of the radome. This exemplary embodiment as well thus uses only the integrated reflector 33, and no separate reflector 3.

However, other antenna elements or antenna element shapes can also be used in an appropriate manner in the exemplary embodiment shown in FIGS. 11 and 12.

The explained exemplary embodiments have been described for the situation in which the conductive structures are incorporated directly in the material of the radome. However, a conductive structure can preferably be used which is coated with paper on at least one side, or preferably on both sides. This offers advantages in the production of the radome, because a flat line structure such as this which is coated with paper on one side and preferably on both sides can be impregnated with resin particularly well. This results in a particularly good connection with the material used for the radome.

As in the case of conventional radome structures, the radome can also have a normal thickness or material thickness. Typical wall thicknesses for the radome are, for example, 1.5 to 4 mm, and frequently between 2 and 3 mm (in particular around 2.3 mm). In this case, greater wall thicknesses are normal at reinforcement points.

As mentioned, the material of the radome is frequently composed of fiber-reinforced plastic. However, a plastic without fiber-reinforced plastic can be used just as well, for example unreinforced ABS.

In the exemplary embodiment which has been explained, the radome is always closed in the circumferential direction (that is to say on its rearward face as well). However, if a metallic reflector is fitted to the antenna in the factory, it may be necessary to provide the radome only on the front face, that is to say in other words covering the antenna elements in front of the reflector on the front face, including the side areas. In a situation such as this, electrically conductive parts can also be incorporated, that is to say electrically conductive flat structures, for example electrically conductive side wall sections 33*a* and/or further conductive structures at other points on the radome or on the radome material, for example in the form of active or passive patches. For example, a patch which is integrated in the material of the radome on the front face of the radome above an antenna element (that is to say a corresponding conductive structure as has been explained, by way of example, with reference to the exemplary embodiments for an integrated reflector) can be stimulated by means of an aperture coupling. This is normally done by means of a printed circuit which contains a feed network above a ground plane. A slot (aperture) is located in the ground plane and is stimulated by the feed network. This slot is then coupled to the patch. With this type of patch feed, there is therefore no need for any conductive connection to a patch in the form of a flat conductive structure in the material of the radome.

As mentioned, single-polarized or, for example, dual-polarized antenna elements or antenna element structures as well, can be used as antenna elements. The antenna may be designed as a single-band, dual-band or multiband antenna. There are no restrictions in any direction.

The invention is not to be limited to the illustrative exemplary non-limiting implementations disclosed herein but rather is defined by the claims.

The invention claimed is:

1. A radome for a mobile radio antenna, said radome including:

a radome structure having a wall comprising material, a reflector, which is not integrated within the radome structure, being disposed within the radome structure at a distance from the wall, and at least one flat line conductive surface structure incorporated in the radome structure wall material, said at least one flat line conductive surface forming a double reflector for the first-mentioned reflector.

2. The radome according to claim 1, wherein the radome structure comprises a front face and a rear wall, the at least one flat line structure being incorporated at least in the rear wall and/or in the front face of the radome structure.

3. The radome according to claim 1, wherein the radome structure comprises a front face and at least two side wall sections, the at least one flat line structure being incorporated in the front face and/or in the side wall sections of the radome in the form of a side wall section or a side wall web.

4. The radome according to claim 1, wherein the flat line structure in the wall of the radome forms an integrated reflector.

5. The radome according to claim 1, wherein the radome structure comprises an enclosure that is closed at least on part of its height and over the entire length thereof in a circumferential direction, said radome enclosure having a rear wall in addition to a front face in side wall sections or has only a front face, with side wall sections.

6. The radome according to claim 1, wherein non-conductive sections comprise a slot structures that pass through the at least one flat line structure.

7. The radome according to claim 1, wherein the flat line structure has branching sections and/or non-conductive sections that form passive beamforming elements.

8. The radome according to claim 1, wherein the at least one flat line structure which is incorporated in the wall forms the single reflector of the mobile radio antenna.

9. The radome according to claim 1, wherein the at least one flat line structure comprises a conductive mesh structure.

10. The radome according to claim 1, wherein the flat line structure is in the form of a metal foil which is coated at least on one side with a layer comprising paper.

11. Radome according to claim 1, wherein an omnidirectional antenna element is accommodated in the interior of the radome.

12. Radome according to claim 1, wherein linearly polarized antenna elements are accommodated in the interior of the radome.

13. Radome according to claim 12 wherein the antenna elements are held and mounted on a supporting strip in the interior of the radome.

14. Radome according to claim 1 wherein only one reflector is provided and is incorporated as an integrated reflector in the material of the radome in the rear wall thereof.

15. Radome according to claim 1, further comprising a further reflector located in front of the rear wall and on which the antenna elements or antenna element groups are arranged.

16. Radome according to claim 1, wherein the flat line structure comprises a line patch.

17. Radome according to claim 1, wherein the mobile radio antenna represents a single-band, a dual-band or a multiband antenna.

18. Radome according to claim 1, wherein the antenna is a single-polarized or dual-polarized antenna.

19. The radome according to claim 1, wherein the at least one flat line structure comprises a hole structure.

20. The radome according to claim 1, wherein the at least one flat line structure comprises a grating structure.

21. The radome according to claim 1, wherein the at least one flat line structure comprises a line grating structure.

22. The radome according to claim 1, wherein the at least one flat line structure comprises a wire mesh structure.

23. A radome for a mobile radio antenna, the radome comprising:

an enclosure comprising a material and having a front face and at least two side wall sections;

at least one conductive surface flat line structure incorporated in the front face and/or in the side wall sections of the radome in the form of a side wall section or a side wall web, said conductive surface flat line structure providing an integrated reflector;

the at least one conductive flat line structure provided in the side wall section forming side wall sections which are associated with the integrated reflector, are electrically connected to the integrated reflector, and/or represent part of the integrated reflector.

24. A radome for a mobile radio antenna, comprising:

radome material, at least one flat line structure incorporated in the material of the radome, wherein the at least one flat line structure has a hole structure, wherein the flat line structure is provided with rows of apertures which run in the longitudinal direction or aligned at an angle with respect to the longitudinal or vertical direction of the radome.

25. The radome according to claim 24, wherein the apertures are of such a size that the opening size or the distance between two conductive elements is less than $\lambda/10$, where $\lambda$ is the wavelength of the highest frequency to be transmitted.

* * * * *